US011413588B2

(12) United States Patent
Pullman et al.

(10) Patent No.: US 11,413,588 B2
(45) Date of Patent: Aug. 16, 2022

(54) MIXING APPARATUS AND SYSTEM

(71) Applicant: SURFACE TO SURFACE INC., Watford (CA)

(72) Inventors: Douglas G. Pullman, Watford (CA); Roger H. Woods, Watford (CA)

(73) Assignee: SURFACE TO SURFACE INC., Watford (CA)

( * ) Notice: Subject to any disclaimer, the term of this patent is extended or adjusted under 35 U.S.C. 154(b) by 377 days.

(21) Appl. No.: 16/698,020

(22) Filed: Nov. 27, 2019

(65) Prior Publication Data

US 2020/0108361 A1 Apr. 9, 2020

Related U.S. Application Data

(62) Division of application No. 15/221,764, filed on Jul. 28, 2016, now Pat. No. 10,507,443.

(60) Provisional application No. 62/197,957, filed on Jul. 28, 2015.

(51) Int. Cl.

| | |
|---|---|
| ***B01F 23/53*** | (2022.01) |
| ***B01F 27/17*** | (2022.01) |
| ***B01F 27/072*** | (2022.01) |
| ***B01F 35/21*** | (2022.01) |
| ***B01F 35/32*** | (2022.01) |
| ***B01F 35/71*** | (2022.01) |
| ***B01F 35/75*** | (2022.01) |
| ***B01F 35/221*** | (2022.01) |
| *B01F 101/25* | (2022.01) |

(52) U.S. Cl.

CPC ..... *B01F 27/17* (2022.01); *B01F 23/53* (2022.01); *B01F 27/0722* (2022.01); *B01F 35/2116* (2022.01); *B01F 35/221422* (2022.01); *B01F 35/32005* (2022.01); *B01F 35/71731* (2022.01); *B01F 35/75415* (2022.01); *B01F 35/75455* (2022.01); *B01F 2101/25* (2022.01)

(58) Field of Classification Search

CPC ..... B01F 23/53
USPC ..... 366/297–300, 326.1
See application file for complete search history.

(56) References Cited

U.S. PATENT DOCUMENTS

| | | | | |
|---|---|---|---|---|
| 1,703,956 | A | 3/1929 | Royer | |
| 1,735,393 | A | 11/1929 | Hiller | |
| 3,556,413 | A | 1/1971 | Lindgren | |
| 4,337,583 | A | 7/1982 | Harris | |
| 5,829,649 | A | 11/1998 | Horton | |
| 6,109,488 | A | 8/2000 | Horton | |
| 6,177,052 | B1 | 1/2001 | Weichs et al. | |
| 9,289,705 | B2 * | 3/2016 | Knauer | C02F 11/14 |
| 2002/0122350 | A1 | 9/2002 | White et al. | |
| 2013/0098843 | A1 * | 4/2013 | Knauer | B01F 27/0722 241/27 |

* cited by examiner

*Primary Examiner* — David L Sorkin
(74) *Attorney, Agent, or Firm* — Medler Ferro Woodhouse & Mills PLLC

(57) ABSTRACT

Provided is a mixing apparatus. The mixing apparatus comprises a housing defining a primary chamber, an inlet for receiving material into the mixing apparatus, as well as an outlet for discharging material from the mixing apparatus. The housing provides within the primary chamber a plurality of rotating shafts, each rotating shaft having a plurality of flailing fixtures associated therewith.

16 Claims, 7 Drawing Sheets

MIXING APPARATUS AND SYSTEM

CROSS-REFERENCE TO RELATED APPLICATIONS

This application is a divisional of prior U.S. application Ser. No. 15/221,764, filed Jul. 28, 2016, now U.S. Pat. No. 10,507,443, which claims the benefit of U.S. Provisional Patent Application Ser. No. 62/197,957, filed Jul. 28, 2015, which are hereby incorporated by reference in their entirety for all purposes.

FIELD

The present disclosure relates to the field of mixers and mixing systems, and in particular to a mixer and system for mixing an additive into a semi-solid material.

BACKGROUND

The cost of handling, transporting and disposing of semi-solid material in comparison to solid material is considerably higher, generally due to the specialized equipment required for safe handling. For example, a truck used to haul semi-solid material will require a sealed box to avoid seepage leaks, and will generally be fitted with a sealed top/cover to stop splashing liquid during transport. It is also generally known that landfill costs are higher for products that will not pass a liquids consistency test, for example a slump test or paint filter liquids test. Transporting solid material to a landfill is more environmentally sound as incidents during transport (i.e. vehicle rollover) are generally easier to manage. Compared to solids, liquids and semi-solid materials that spill during transport can have devastating environmental effects due to ease of spreading, as well as leaching into the ground.

Methods to convert liquid and semi-solid material into solid form suitable for disposal as conventional solid waste are known. Such methods involve the mixing of an additive to the liquid or semi-solid material to promote solidification. Traditional mixing/blending methods require batch mixing with devices such as pug mixers, mixing augers, or excavators/loaders that physically maul the two products together in a pit, tank or on the ground surface. With these traditional methods, "overdosing" is quite common, generally to address and compensate for poor mixing and clumping of the additive. In addition, the introduction of the additive to the semi-solid material is often complicated by dust issues that in itself presents a variety of health and safety concerns.

SUMMARY

According to an aspect of the disclosure, provided is a mixing apparatus. The mixing apparatus comprises a housing defining a primary chamber, an inlet for receiving material into the mixing apparatus, as well as an outlet for discharging material from the mixing apparatus. The housing provides within the primary chamber a plurality of rotating shafts, each rotating shaft having a plurality of flailing fixtures associated therewith.

According to another aspect of the disclosure, provided is a mixing system comprising a material bulk hopper, a treatment additive hopper, and a premix chamber configured to receive material discharged from both the material bulk hopper and the treatment additive hopper, the premix chamber providing a premix action to the combined material and treatment additive. The combined material and treatment additive from the premix chamber is discharged from the premix chamber into a mixing apparatus, the mixing apparatus having a primary chamber configured with a plurality of rotating shafts having a plurality of flailing fixtures associated therewith.

According to another aspect of the disclosure, provided is a process for mixing a treatment additive into a semi-solid material. The process comprises transporting the semi-solid material from a containment structure and introducing it into a mixing apparatus. Adding to the flow of semi-solid material being added to the mixing apparatus a treatment additive. Subjecting the combined semi-solid material and treatment additive to a mixing action that disrupts the semi-solid material to allow the treatment additive to incorporate into the semi-solid material at a particulate size level, the mixing action including a fracturing action.

BRIEF DESCRIPTION OF THE DRAWINGS

The foregoing and other features and advantages will be apparent from the following description of the disclosure as illustrated in the accompanying drawings. The accompanying drawings, which are incorporated herein and form a part of the specification, further serve to explain the principles of the disclosure and to enable a person skilled in the pertinent art to make and use the disclosure. The drawings are not to scale.

DETAILED DESCRIPTION

Specific embodiments of the present disclosure will now be described with reference to the Figures, wherein like reference numbers indicate identical or functionally similar elements. The following detailed description is merely exemplary in nature and is not intended to limit the disclosure or the application and uses of the disclosure. A person skilled in the relevant art will recognize that other configurations and arrangements can be used without departing from the scope of the disclosure. Although the description and drawings of the embodiments hereof exemplify a mixing apparatus and system as applied to mixing semi-solid material for the purpose of waste disposal, the disclosure may also be used in other mixing applications, for example in industrial manufacturing processes. Furthermore, there is no intention to be bound by any expressed or implied theory presented in the preceding technical field, background, brief summary or the following detailed description.

Provided is a mixing apparatus and system designed to take a semi-solid material (i.e. a high viscous or non-pumpable sludge) and blend it with a treatment additive or reagent to absorb and capture as much liquid as possible, thereby creating a drier, low slump final product. The desired low slump final product should be sufficiently dry to be suitable for conventional solid waste disposal.

Figure 1:
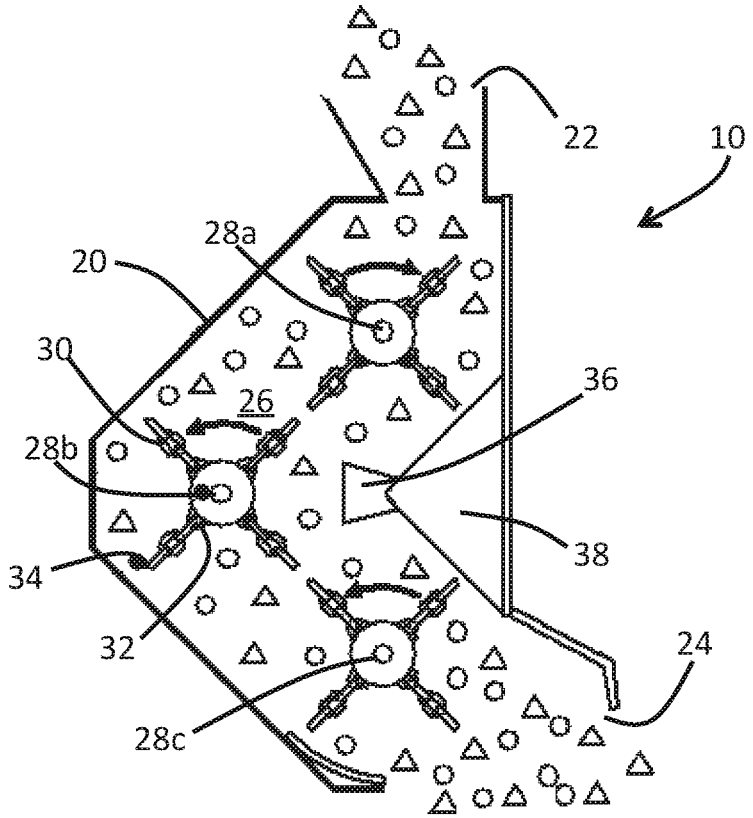
FIG. 1 is a schematic view of a general flail box according to a first embodiment.
Figure 2:
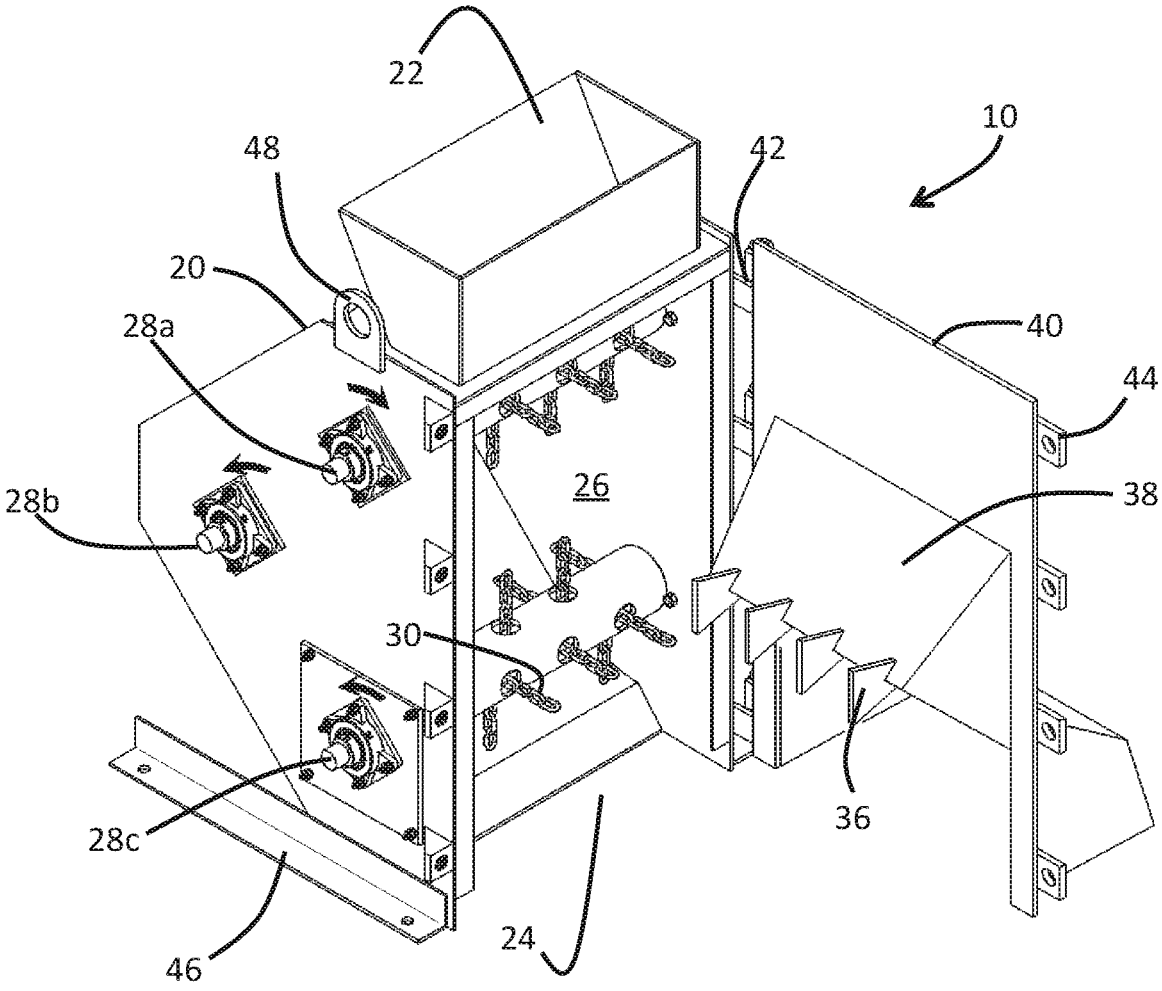
FIG. 2 is a perspective view of the flail box according to the embodiment of FIG. 1.

Turning now to FIGS. 1 and 2, shown is a mixing apparatus, herein referred to as flail box 10. Flail box 10 comprises a housing 20 having an inlet 22 and an outlet 24, and primary chamber 26 defining a mixing environment contained therein. Housing 20 supports a plurality of rotating shafts arranged generally horizontally relative to the operating position of flail box 10. In the embodiment shown, three rotating shafts 28*a*, 28*b*, 28*c* are provided. Each rotating shaft 28*a*, 28*b*, 28*c* is provided with a plurality of flailing fixtures 30. As noted, flail box 10 is constructed in such a manner as to receive and route material onto shafts 28*a*, 28*b*, 28*c*, and thereby engaging flailing fixtures 30 attached thereto. Flailing fixtures 30 are securely fastened typically at a connection end 32 to a respective shaft 28, either through direct attachment, or a suitable attachment fixture, and the remaining disruptor end 34 is left to move about freely or may be looped back to shaft 28. This action allows the disruptor end 34 or loop to whip, hammer, flail or flex as it makes contact with the material due to centrifugal force and momentum. Flail fixtures 30 can be constructed from various materials such as, but not limited to, iron flat bar, chain, chain with end weights, wire cable or other materials meant to resist wear and maintain their original integrity. A combination of different flail fixtures 30 may be used together to achieve a specific action or abrasion resistance if desired. The spacing and location of flail fixtures 30 on shafts 28*a*, 28*b*, 28*c* may also be configured to achieve a specific action or abrasion resistance if desired. The rotating shaft closer to the inlet 22 may have a spacing between adjacent flail fixtures 30 that differs from the spacing between adjacent flail fixtures 30 provided on the rotating shaft that is closer to the outlet 24. The rotating shaft(s) between the rotating shafts proximal the inlet 22 and the outlet 24 may have a spacing between adjacent flail fixtures that is intermediate thereof. In one example, the spacing between adjacent flailing fixtures is selected to present a wider spacing between adjacent flailing fixtures on rotating shafts closer to the inlet 22, and where the spacing progressively becomes narrower for each rotating shaft arranged towards the outlet 24.

Rotating shafts 28*a*, 28*b*, 28*c* are power driven (for example by gears, belts, chains, motors or a combination thereof) in such a way to rotate at variable speed(s) and predetermined direction(s). For example, having regard to the perspective shown in FIG. 2, shaft 28*a* rotates in a clockwise direction, while the two remaining shafts 28*b*, 28*c* rotate in a counter-clockwise direction. The rotational speed of shafts 28*a*, 28*b*, 28*c* can also be set at different speeds to achieve a desired outcome. One example may have one shaft (i.e. shaft 28*b*) rotating at 900 revolutions per minute (rpm) and the remaining two shafts (i.e. shafts 28*a*, 28*c*) rotating at 1000 rpms. As flail fixtures 30 impact material contained within primary chamber 26, it is broken down in size and is distributed in different directions at different speeds throughout flail box 10.

As seen in FIG. 2, flail box 10 may additionally comprise protrusions 36 (i.e. baffles) that extend into the primary chamber 26, the protrusions 36 having sharp edges upon which the material is propelled and rebounded against thus enhancing the breakdown and mixing action as the material travels down towards the outlet 24 of flail box 10. In some embodiments, flail box 10 may also be fitted with flow guides 38 that extend into the primary chamber 26, the flow guides 38 aiding the routing of the material to achieve the desired effectiveness of the flails, or abrasion reduction of the flailing box. Flail box 10 may be provided with an opening panel 40 to facilitate cleaning/maintenance and/or repair. Accordingly, flail box 10 is provided with corresponding hinges 42 and latches/locks 44 to enable opening/closing and securement of panel 40 as required during use. In addition, flail box 10 may provide attachment fixtures, such as bracket 46 and/or lift hook 48 to facilitate locating and anchoring flail box 10 in position, for example when incorporated into a mixing system as will be described in greater detail below.

It will be appreciated that a variety of mixing apparatus configurations are possible in addition to that exemplified in FIGS. 1 and 2. For example, the mixing apparatus shown in FIG. 3 (herein referred to as flail box 110) presents a more predominant vertical footprint, while retaining many of the structural and operational aspects of flail box 10. Flail box 110 comprises a housing 120 having an inlet 122 and an outlet 124, and primary chamber 126 defining a mixing environment contained therein. Housing 120 supports a plurality of rotating shafts arranged to engage material in primary chamber 126. In the embodiment shown, four rotating shafts 128*a*, 128*b*, 128*c*, 128*d* are provided, arranged generally horizontally relative to the operating position of flail box 110. In addition, one rotating shaft 128*e* is provided in a generally vertical arrangement. Each rotating shaft 128*a*, 128*b*, 128*c*, 128*d*, 128*e* is provided with a plurality of flailing fixtures 130. As noted, flail box 110 is constructed in such a manner as to receive and route material onto shafts 128*a*, 128*b*, 128*c*, 128*d*, 128*e* thereby engaging flailing fixtures 130 attached thereto. Flailing fixtures 130 are securely fastened typically at a connector end 132 to a respective shaft 128, either through direct attachment, or a suitable attachment fixture, and the remaining disruptor end 134 is left to move about freely or may be looped back to shaft 128. This action allows the disruptor end 134 or loop to whip, hammer, flail or flex as it makes contact with the material due to centrifugal force and momentum. Flail fixtures 130 can be constructed from various materials such as, but not limited to, iron flat bar, chain, chain with end weights, wire cable or other materials meant to resist wear and maintain their original integrity. A combination of different flail fixtures 130 may be used together to achieve a specific action or abrasion resistance if desired. The spacing and location of flail fixtures 130 on shafts 128*a*, 128*b*, 128*c*, 128*d*, 128*e* may also be configured to achieve a specific action or abrasion resistance if desired. The rotating shaft closer to the inlet 122 may have a spacing between adjacent flail fixtures 130 that differs from the spacing between adjacent flail fixtures 130 provided on the rotating shaft that is closer to the outlet 124. The rotating shaft(s) between the rotating shafts proximal the inlet 122 and the outlet 124 may have a spacing between adjacent flail fixtures that is intermediate thereof. In one example, the spacing between adjacent flailing fixtures is selected to present a wider spacing between adjacent flailing fixtures on rotating shafts closer to the inlet 122, and where the spacing progressively becomes narrower for each rotating shaft arranged towards the outlet 124.

Rotating shafts 128*a*, 128*b*, 128*c*, 128*d*, 128*e* are power driven (for example by gears, belts, chains, motors or a combination thereof) in such a way to rotate at variable speed(s) and predetermined direction(s). For example, shafts 128*a*, 128*b*, 128*c*, 128*d* may rotate in alternating clockwise/counter-clockwise direction, while shaft 128*e* may rotate in either direction. In such an arrangement, having regard to the view shown in FIG. 3, shafts 128*a* and 128*c* may rotate clockwise, while shafts 128*b* and 128*d* may rotate counter-clockwise. The rotational speed of shafts 128*a*, 128*b*, 128*c*, 128*d*, 128*e* can also be set at different speeds to achieve a desired outcome. One example may have shafts 128*a*, 128*b*, 128*c*, 128*d*, 128*e* rotating at speeds alternating between 900 revolutions per minute (rpm) and 1000 rpm. In such an arrangement, shafts 128*a* and 128*c* may rotate at 900 rpm, while shafts 128*b* and 128*d* may rotate at 1000 rpm. As flail fixtures 130 impact material contained within primary chamber 126, it is broken down in size and is distributed in different directions at different speeds throughout flail box 110.

Figure 3:
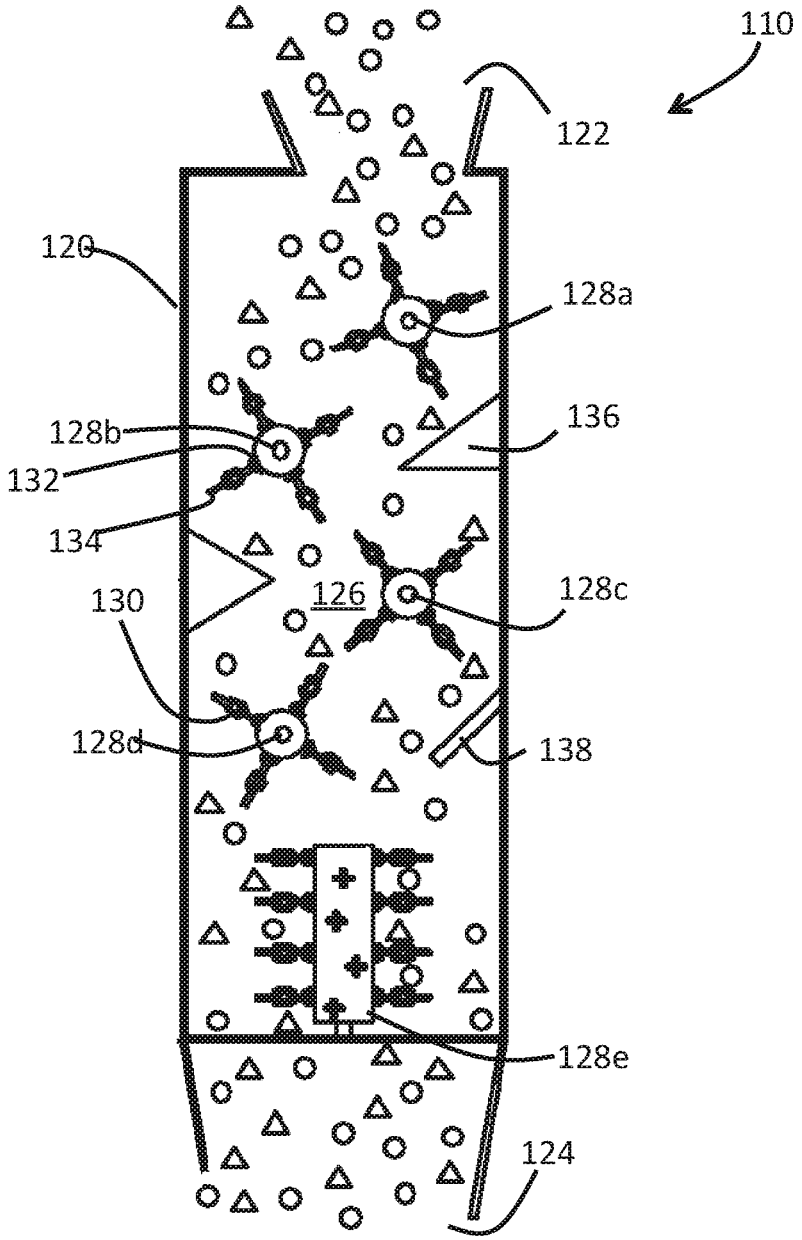
FIG. 3 is an alternate embodiment of the flail box having a generally vertical footprint.

As seen in FIG. 3, flail box 110 may additionally comprise protrusions 136 (i.e. baffles) that extend into the primary chamber 126, the protrusions 136 having sharp edges upon which the material is propelled and rebounded against thus enhancing the breakdown and mixing action as the material travels down towards the outlet 124 of flail box 110. In some embodiments, flail box 110 may also be fitted with flow guides 138 that extend into the primary chamber 126, the flow guides 138 aiding the routing of the material to achieve the desired effectiveness of the flails, or abrasion reduction of the flailing box. Although not detailed in FIG. 3, flail box 110 may also be provided with features such as maintenance panels and attachment fixtures, as exemplified in FIG. 2 for flail box 10.

Figure 4:
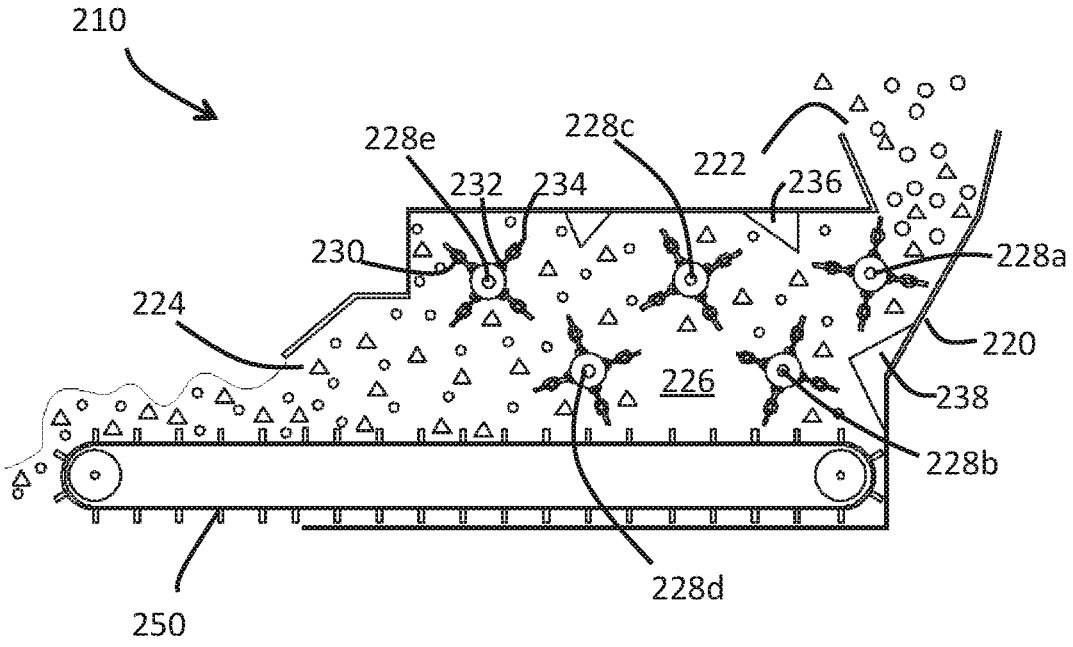
FIG. 4 is an alternate embodiment of the flail box having a generally horizontal footprint.

Turning now to FIG. 4, shown is a mixing apparatus (herein referred to as flail box 210) having a more predominant horizontal footprint, while retaining many of the structural and operational aspects of flail box 10. Flail box 210 comprises a housing 220 having an inlet 222 and an outlet 224, and primary chamber 226 defining a mixing environment contained therein. Housing 220 supports a plurality of rotating shafts arranged to engage material in primary chamber 226. In the embodiment shown, five rotating shafts 228*a*, 228*b*, 228*c*, 228*d*, 228*e* are provided, arranged generally horizontally relative to the operating position of flail box 210. Each rotating shaft 228*a*, 228*b*, 228*c*, 228*d*, 228*e* is provided with a plurality of flailing fixtures 230. As noted, flail box 210 is constructed in such a manner as to receive and route material onto shafts 228*a*, 228*b*, 228*c*, 228*d*, 228*e*, thereby engaging flailing fixtures 230 attached thereto. Flailing fixtures 230 are securely fastened typically at a connector end 232 to a respective shaft 228, either through direct attachment, or a suitable attachment fixture, and the remaining disruptor end 234 is left to move about freely or may be looped back to shaft 228. This action allows the disruptor end 234 or loop to whip, hammer, flail or flex as it makes contact with the material due to centrifugal force and momentum. Flail fixtures 230 can be constructed from various materials such as, but not limited to, iron flat bar, chain, chain with end weights, wire cable or other materials meant to resist wear and maintain their original integrity. A combination of different flail fixtures 230 may be used together to achieve a specific action or abrasion resistance if desired. The spacing and location of flail fixtures 230 on shafts 228*a*, 228*b*, 228*c*, 228*d*, 228*e* may also be configured to achieve a specific action or abrasion resistance if desired. The rotating shaft closer to the inlet 222 may have a spacing between adjacent flail fixtures 230 that differs from the spacing between adjacent flail fixtures 230 provided on the rotating shaft that is closer to the outlet 224. The rotating shaft(s) between the rotating shafts proximal the inlet 222 and the outlet 224 may have a spacing between adjacent flail fixtures that is intermediate thereof. In one example, the spacing between adjacent flailing fixtures is selected to present a wider spacing between adjacent flailing fixtures on rotating shafts closer to the inlet 222, and where the spacing progressively becomes narrower for each rotating shaft arranged towards the outlet 224.

Rotating shafts 228*a*, 228*b*, 228*c*, 228*d*, 228*e* are power driven (for example by gears, belts, chains, motors or a combination thereof) in such a way to rotate at variable speed(s) and predetermined direction(s). For example, shafts 228*a*, 228*b*, 228*c*, 228*d*, 228*e* may rotate in alternating clockwise/counter-clockwise direction. In such an arrangement, having regard to the view shown in FIG. 4, shafts 228*a*, 228*c*, and 228*e* may rotate clockwise, while shafts 228*b* and 228*d* may rotate counter-clockwise. The rotational speed of shafts 228*a*, 228*b*, 228*c*, 228*d*, 228*e* can also be set at different speeds to achieve a desired outcome. One example may have shafts 228*a*, 228*b*, 228*c*, 228*d*, 228*e* rotating at speeds alternating between 900 revolutions per minute (rpm) and 1000 rpm. In such an arrangement, shafts 228*a*, 228*c*, and 228*e* may rotate at 900 rpm, while shafts 228*b* and 228*d* may rotate at 1000 rpm. As flail fixtures 230 impact material contained within primary chamber 226, it is broken down in size and is distributed in different directions at different speeds throughout flail box 210.

As seen in FIG. 4, flail box 210 may additionally comprise protrusions 236 (i.e. baffles) that extend into the primary chamber 226, the protrusions 236 having sharp edges upon which the material is propelled and rebounded against thus enhancing the breakdown and mixing action as the material travels down towards the outlet 224 of flail box 210. In some embodiments, flail box 210 may also be fitted with flow guides 238 that extend into the primary chamber 226, the flow guides 238 aiding the routing of the material to achieve the desired effectiveness of the flails, or abrasion reduction of the flailing box. Although not detailed in FIG. 4, flail box 110 may also be provided with features such as maintenance panels and attachment fixtures, as exemplified in FIG. 2 for flail box 10.

To facilitate movement of material within flail box 210, there may also be provided within housing 220 a conveyor means 250 (i.e. a belt conveyer, screw conveyer, bucket) arranged to direct material collecting towards the bottom of primary chamber 226 towards outlet 224. Alternatively, the bottom wall of primary chamber 226 may be sloped towards outlet 224 to promote movement of material.

It will be appreciated that other configurations for flailing box 10, 110, 210 are possible and may be suitably implemented to achieve a desired mixing behavior/performance. For example, the flail box may have a greater number or lesser number of rotating shafts than the examples detailed above. It is also possible to have a flail box with solely horizontal rotating shafts, or solely vertical rotating shafts or various combinations of horizontal and vertical shafts to achieve a desired mixing performance. The rotational direction and/or speeds may also be set and/or adjustable to achieve a desired performance.

Flail box 10, 110, 210 is suited for use in mixing a semi-solid material with a second material. The second material may be any secondary additive, such as a treatment additive. Suitable treatment additives include dry, liquid and semi-solid treatment additives. For the following discussion, the second material is regard to as a dry additive. Flail box 10, 110, 210 serves to disrupt the semi-solid material to allow the dry additive to mix/blend and incorporate into the semi-solid material with reduced clumping of the semi-solid material and/or the dry additive. In some embodiments, the disruption of the semi-solid material and dry additive targets a particulate (dust) size level. Disruption with flail box 10, 110, 210 presents as a fracturing action that promotes large particulates to be fractured/split into smaller particulates for better surface contact with the dry additive. Balling and clumping of both semi-solid material and dry additive are reduced, thus reducing the amount of dry product used and wasted.

Figure 5:
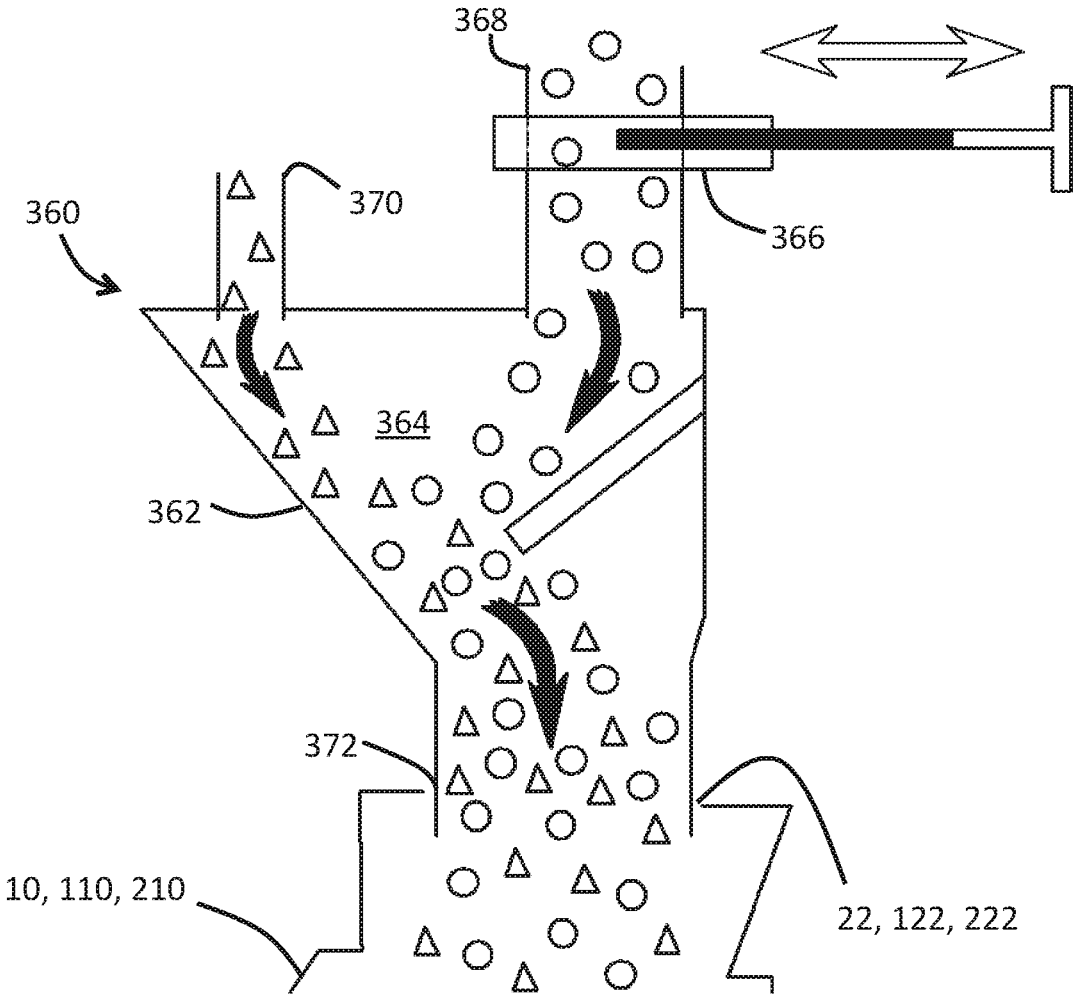
FIG. 5 is a schematic view of a bulk hopper suited for use with the flail box of FIGS. 1, 3 and 4.

While flailing box 10, 110, 210 may be provided as a separate standalone mixing apparatus, it may also be associated with additional operating components of a larger mixing system. For example, shown in FIG. 5 is a bulk hopper 360 for feeding material into inlet 22, 122, 222 of a respective flail box 10, 110, 210. Bulk hopper 360 provides a housing 362 defining a covered mixing chamber 364, a material control valve 366 mounted on inlet 368, secondary inlet 370, and an outlet 372 for releasing mixed materials to inlet 22, 122, 222 of flail box 10, 110, 210. Inlet 368 is intended to receive a first material (i.e. the semi-solid material for processing) while secondary inlet 370 is intended to receive a second material (i.e. the dry additive).

It will be appreciated that a flailing box design (for example one of flailing box 10, 110, 210) may be incorporated into a larger mixing system. Mixing systems contemplated here provide efficient processing/mixing of semi-solid material and dry additive in a continuous real time operation as opposed to a batch process. By achieving a homogeneous well-blended and proportioned mix, less dry additive will be needed, thus reducing the cost of the dry additive used and reducing the final total weight and volume of the solid to be disposed of.

It will be appreciated that multiple configurations of the mixing system are possible. In one exemplary configuration, the basic process is generally comprised of 1) moving the semi-solid material from a containment structure (pit, pond, or tank) to the main mixing unit, 2) weighing the input semi-solid material or using a volumetric calculation, as it enters the mixing unit, 3) metering of the dry additive into the mixing unit, and incorporating it into the semi-solid material flow, 4) rapid shearing and mix/blending of the dry additive into the semi-solid material, and 5) final handling or processing stage for the appropriate and adequate finished end product.

Figure 6:
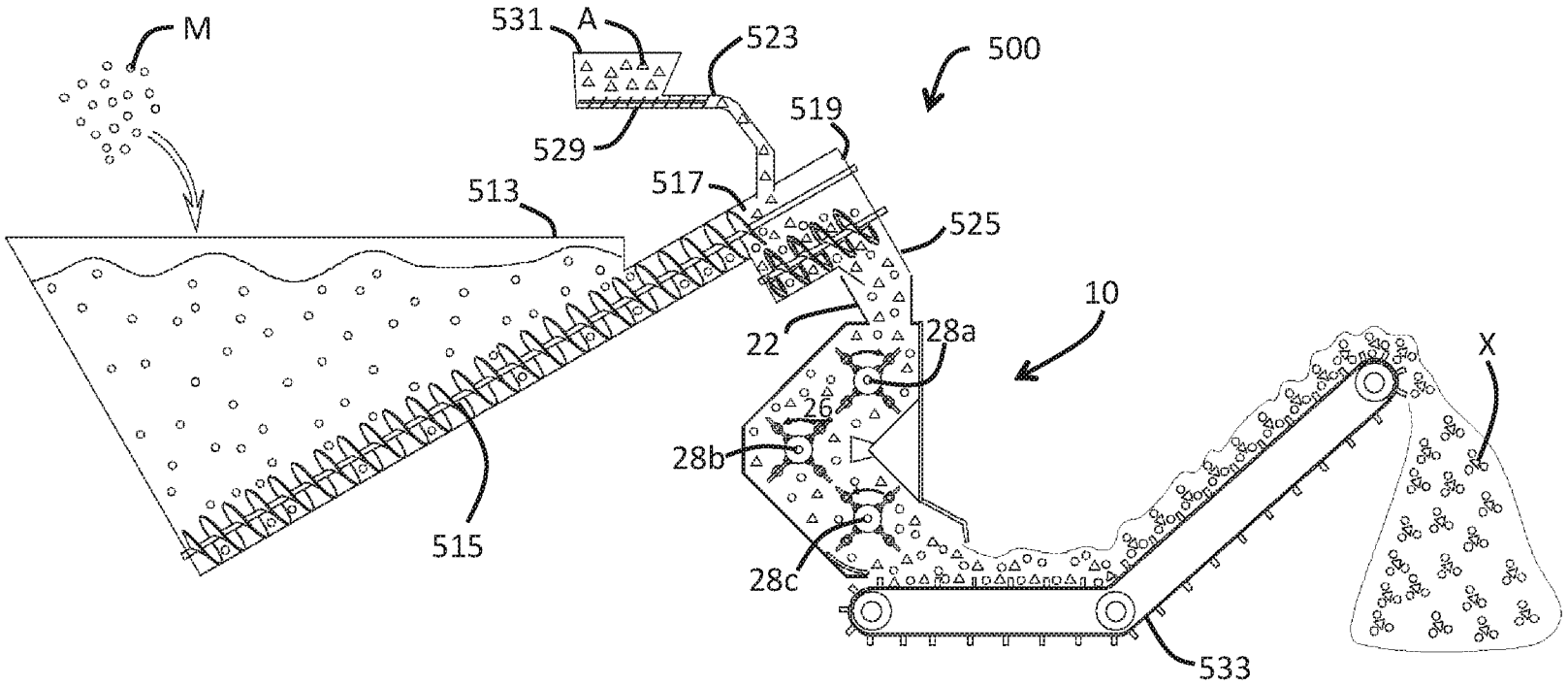
FIG. 6 is a schematic representation of a mixing system for use on semi-solid materials.

One exemplary embodiment of a mixing system for mixing a dry additive into a semi-solid material is shown in FIG. 6. In this particular embodiment, mixing system 500 incorporates flail box 10 for illustrative purpose. The process begins with semi-solid material M being transferred to a suitable hopper for delivery into flail box 10. One such hopper could include bulk hopper 360 detailed above (see FIG. 5). In mixing system 500, a variation is provided in the form of a powered material hopper 513. Powered material hopper 513 is provided with a conveyor 515, for example a variable speed screw conveyor (i.e. auger) to deliver semi-solid material M to flail box 10. By implementing a conveyor 515 in the form of a variable speed auger, the delivery of semi-solid material M may be controlled, with conveyor 515 being used as a means to weigh or determine the volume of semi-solid material M, thereby coordinating material flow with the proper ratio of dry additive.

Although not shown, the means by which semi-solid material M is delivered to powered material hopper 513 may take on a variety of forms. For example, semi-solid material M may be excavated from a holding tank or pit by means of a mechanical bucket, such as a hydraulic excavator or loader, a vacuum truck, or any other suitable method for handling viscous material.

Figure 7:
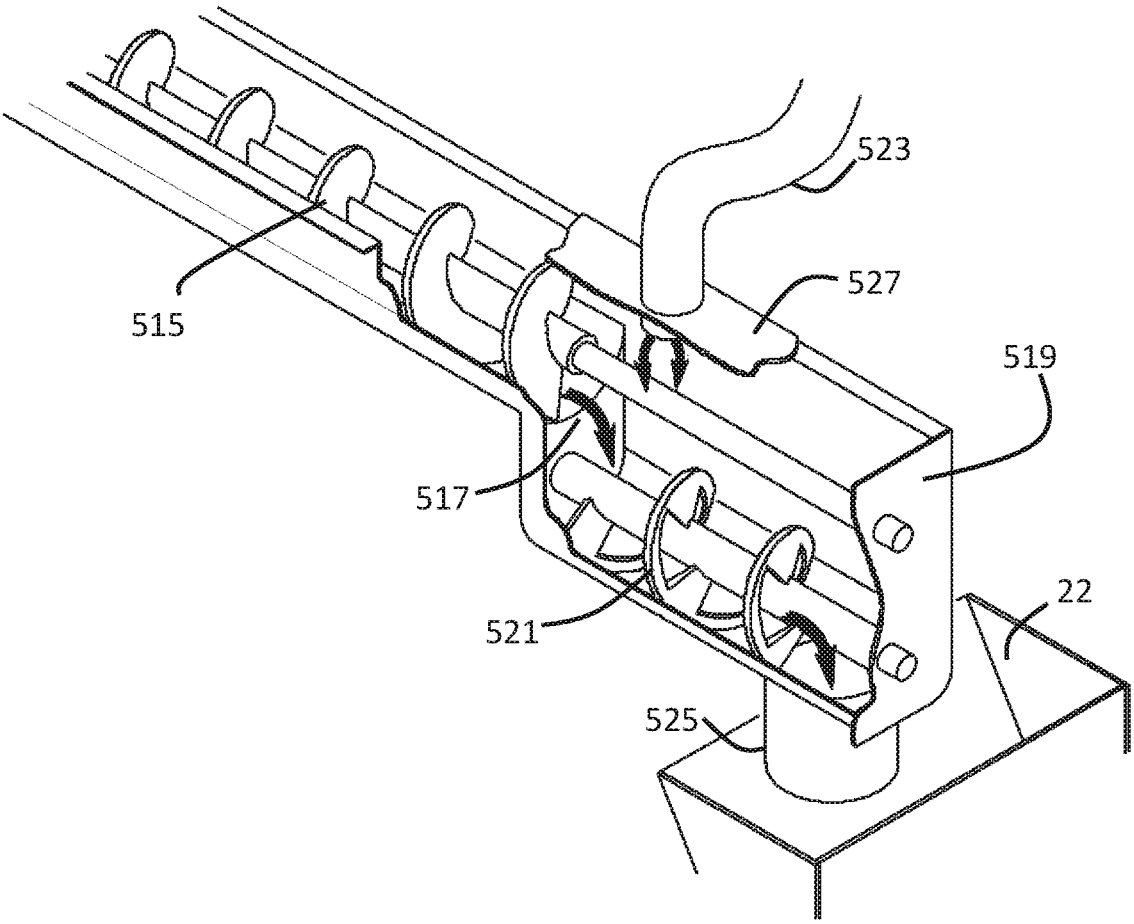
FIG. 7 is a perspective partial sectional view of a premix chamber incorporated into the mixing system of FIG. 6.

Provided at discharge end 517 of conveyer 515 is a premix chamber 519 configured to receive both semi-solid material M and the dry additive A delivered via powered material hopper 513. FIG. 7 provides a detailed view of premix chamber 519 suitable for use in mixing system 500. Premix chamber 519 consists of independently driven, secondary conveyor 521 (i.e. a ribbon auger), a dry additive delivery conduit 523 extending from a dry additive hopper (not shown), a discharge conduit 525 associated with inlet 22 of flail box 10, and an enclosure (i.e. sealed top cover) 527. As detailed previously premix chamber 519 receives semi-solid material M through material inlet 529 via conveyor 515.

As semi-solid material M is deposited into premix chamber 519, a predetermined amount of dry additive A is also introduced via conduit 523. For example, the desired amount of dry additive A is pre-established on the basis of a preliminary small-scale test where an optimal ratio of dry additive to semi-solid material M is determined. Secondary conveyor 521 combines the two together as it carries them to discharge conduit 525. By virtue of enclosure 527, dust from dry additive A is contained within premix chamber 519.

Premix chamber 519 may be configured to determine the weight or volume of the incoming semi-solid material M to coordinate flow with the proper ratio of dry additive A. Examples of this might include but not limited to installing load cells, monitoring torque of the ribbon auger, or other mechanical or electrical devices used for this purpose.

On determining the proper mix ratio dry additive A is accurately metered into the semi-solid material M by a means of a suitable mechanism, for example auger 529 provided on dry additive hopper 531. The size and speed of auger 529 would determine the amount of dry additive A leaving dry additive hopper 531 for mixing into semi-solid material M. As an alternative to auger 529, a variety of different types of metering devices such as, but not limited to, manual, air, or vacuum methods are available that could be used to meter in the dry additive.

The combined semi-solid material M and dry additive A mixture is then premixed and transported via secondary conveyor 521 to discharge conduit 525 of premix chamber 519, where it falls by gravity through inlet 22 of flail box 10, into primary chamber 26 and the action of the rotating shafts 28*a*, 28*b*, 28*c* contained therein. As detailed previously, the flail box serves to disrupt semi-solid material M to allow dry additive A to mix/blend and incorporate into semi-solid material M at a particulate (dust) size level. This action allows large particulate to be fractured/split into smaller particulate for better surface contact with the dry additive. Balling and clumping of both semi-solid material and dry additive are reduced, thus reducing the amount of dry product used and wasted.

On discharge through outlet 24 of flail box 10, the final blended mixture X is collected and removed. In the embodiment shown, mixing system 10 implements a transporter 533 (i.e. a belt conveyer, screw conveyer, or bucket) to direct blended mixture X from outset 24 to its final destination (i.e. a holding pit or disposal transport truck), or in certain treatment regimens, secondary processing. Secondary processing may include, but is not limited to processes that change the solidified mixture's structure, texture, moisture content and/or physical characteristics. For example, to quickly reduce moisture content and/or destroy pathogens, bacteria, or foreign substances that are unfavorable in the final product, blended mixture X may be subject to a heat source such as a flame, induction heating or microwaves. Blended mixture X may also be subject to tumbling in a rotary drum to turn the solidified mixture into smaller compacted "balls" thus creating a large surface area per ball to allow air drying or to benefit from the above mentioned heat process. Blended mixture X, now present in a substantially solidified form, can now be handled in such a way to be extruded, compressed, spread, bagged, or combined with other low moisture ingredients. In this form, blended mixture X may be handled as a solid, permitting for conventional solids disposal.

Dry additives suitable for use in the aforementioned mixing system 10 may be of the type designed to encapsulate any hazardous waste contained in the semi-solid material or liquid portion thereof. A non-limiting example of additives includes polymer/bentonite blend, sawdust, Portland cement, lime, fly ash, zeolite, other dry products already in use, and combinations thereof. Although the mixing apparatus and system have been described and exemplified having regard to dry additives being used for treatment of the semi-solid material, the mixing apparatus and system may also be used with other treatment additives, for example liquid additives or semi-solid additives. For example, the mixing apparatus and system may be used with a wet portland cement-type additive. Where a liquid additive or semi-solid additive is used, a suitable treatment additive hopper may be used in place of the dry additive hopper.

It will be appreciated that the assembly of components as shown in FIG. 6 is exemplary and under some operations environments, the system may be provided with additional or fewer system components. For example, in some embodiments, transporter 533 may not be implemented and mixture X may feed directly into a receiving structure (i.e. a truck box).

It is important to note that the construction and arrangement of the features in the various exemplary embodiments is illustrative only. Although only a few embodiments have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, colors, orientations, etc.) without materially departing from the novel teachings and advantages of the subject matter herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications changes and omissions may also be made in design, operating conditions and arrangement of the various exemplary embodiments without departing from the present scope of the disclosure. It will also be understood that each feature of each embodiment discussed herein, and of each reference cited herein, can be used in combination with the features of any other combination. All patents and publications discussed herein are incorporated by reference herein in their entirety.

What is claimed is:

1. A process for breaking down and mixing a semi-solid material with a treatment additive in a mixing apparatus to absorb and capture liquid in the semi-solid material, and thereby discharge from the mixing apparatus a mixture that will become a low slump material, the process comprising:

receiving the semi-solid material and the treatment additive into an inlet of the mixing apparatus, the mixing apparatus having a housing defining a primary chamber with the inlet and an outlet, the outlet being disposed vertically below the inlet;

routing the semi-solid material and the treatment additive onto a plurality of rotating shafts of the primary chamber, each rotating shaft being disposed perpendicular to a flow path that the semi-solid material and the treatment additive take from the inlet to the outlet of the primary chamber, each of the rotating shafts being vertically spaced from another of the rotating shafts along the flow path;

breaking down and mixing the semi-solid material and the treatment additive by interaction with a plurality of flailing fixtures movably attached to each of the plurality of rotating shafts, with each flailing fixture having a disrupter end that moves about freely relative to its respective rotating shaft to make contact with the semi-solid material and the treatment additive due to centrifugal force and momentum provided by the respective rotating shaft, wherein during the breaking down and mixing action the treatment additive absorbs and captures liquid in the semi-solid material to create the mixture to be discharged; and discharging, from the outlet of the mixing apparatus, the mixture that will become the low slump material.

2. The process of claim 1, wherein the housing is constructed in such a manner as to route the semi-solid material and the treatment additive along the flow path onto each of the rotating shafts that transversely cross the primary chamber to thereby interact with the plurality of flailing fixtures disposed thereon.

3. The process of claim 1, wherein each of the plurality of flailing fixtures is configured to flail and to thereby enhance the breaking down and mixing action within the primary chamber of the mixing apparatus.

4. The process of claim 1, wherein the plurality of rotating shafts are arranged within the primary chamber horizontally relative to an operating position of the mixing apparatus.

5. The process of claim 1, wherein the plurality of flailing fixtures associated with each rotating shaft is arranged with a spacing between adjacent flailing fixtures that is configured to achieve a specific mixing action.

6. The process of claim 1, further comprising rotating one or more of the plurality of rotating shafts in a different direction than another of the plurality of rotating shafts.

7. The process of claim 1, wherein the housing additionally comprises one or more flow guides extending into the primary chamber to aid in the routing of the semi-solid material and the treatment additive along the flow path within the primary chamber of the mixing apparatus.

8. The process of claim 1, wherein one or more protrusions having sharp edges extend(s) into the primary chamber from a wall of the housing to enhance the breaking down and mixing action within the primary chamber.

9. The process of claim 1, wherein at least one of the plurality of the rotating shafts along the flow path is configured to rotate one of a clockwise or counter-clockwise direction and at least another of the plurality of the rotating shafts along the flow path is configured to rotate in an opposite direction thereto.

10. A process for breaking down and mixing a semi-solid material with a treatment additive in a mixing apparatus to absorb and capture liquid in the semi-solid material, and thereby discharge from the mixing apparatus a mixture that will become a low slump material, the process comprising:

receiving the semi-solid material and the treatment additive into an inlet of the mixing apparatus, the mixing apparatus having a housing defining a primary chamber with the inlet and an outlet, the outlet being disposed vertically below the inlet;

routing the semi-solid material and the treatment additive onto at least one rotating shaft of the primary chamber, the at least one rotating shaft being disposed perpendicular to a flow path that the semi-solid material and the treatment additive take from the inlet to the outlet of the primary chamber;

breaking down and mixing the semi-solid material and the treatment additive by interaction with a plurality of flailing fixtures movably attached the at least one rotating shaft, with each flailing fixture having a disrupter end that moves about freely relative to the at least one rotating shaft to make contact with the semi-solid material and the treatment additive due to centrifugal force and momentum provided by the at least one rotating shaft, wherein during the breaking down and mixing action the treatment additive absorbs and captures liquid in the semi-solid material to create the mixture to be discharged; and discharging, from the outlet of the mixing apparatus, the mixture that will become the low slump material.

11. The process of claim 10, wherein the housing is constructed in such a manner as to route the semi-solid material and the treatment additive along the flow path onto the at least one rotating shaft that transversely crosses the primary chamber to thereby interact with the plurality of flailing fixtures disposed thereon.

12. The process of claim 10, wherein each of the plurality of flailing fixtures is configured to flail and to thereby enhance the breaking down and mixing action within the primary chamber of the mixing apparatus.

13. The process of claim 10, wherein the at least one rotating shaft is arranged within the primary chamber horizontally relative to an operating position of the mixing apparatus.

14. The process of claim 10, wherein the plurality of flailing fixtures associated with the at least one rotating shaft is arranged with a spacing between adjacent flailing fixtures that is configured to achieve a specific mixing action.

15. The process of claim 10, wherein the housing additionally comprises one or more flow guides extending into the primary chamber to aid in the routing of the semi-solid material and the treatment additive along the flow path within the primary chamber of the mixing apparatus.

16. The process of claim 10, wherein one or more protrusions having sharp edges extend(s) into the primary chamber from a wall of the housing to enhance the breaking down and mixing action within the primary chamber.

* * * * *